US008328697B2

(12) United States Patent
Farbshteyn

(10) Patent No.: US 8,328,697 B2
(45) Date of Patent: Dec. 11, 2012

(54) DEVICE FOR CHANGING LOAD AT ANY PHASE OF MOVEMENT

(76) Inventor: Vadim Yuryevich Farbshteyn, Angarsk (RU)

( * ) Notice: Subject to any disclaimer, the term of this patent is extended or adjusted under 35 U.S.C. 154(b) by 218 days.

(21) Appl. No.: 12/734,788

(22) PCT Filed: Nov. 28, 2008

(86) PCT No.: PCT/RU2008/000746
§ 371 (c)(1),
(2), (4) Date: May 24, 2010

(87) PCT Pub. No.: WO2009/082266
PCT Pub. Date: Jul. 2, 2009

(65) Prior Publication Data

US 2010/0242644 A1 Sep. 30, 2010

(30) Foreign Application Priority Data

Dec. 20, 2007 (RU) ..... 2007147696

(51) Int. Cl.
*A63B 21/062* (2006.01)

(52) U.S. Cl. ..... 482/100; 482/92; 482/93

(58) Field of Classification Search ..... 482/92, 482/93, 97, 908; 601/23, 33, 35
See application file for complete search history.

(56) References Cited

U.S. PATENT DOCUMENTS

| | | | | |
|---|---|---|---|---|
| 4,405,128 | A * | 9/1983 | Mclaughlin et al. | 482/97 |
| 4,753,437 | A * | 6/1988 | Lapcevic | 482/97 |
| 4,854,578 | A | 8/1989 | Fulks | |
| 6,019,711 | A * | 2/2000 | Koenig | 482/97 |
| 6,350,219 | B1 * | 2/2002 | Hobson | 482/97 |

FOREIGN PATENT DOCUMENTS

| | | |
|---|---|---|
| DE | 19710132 | 11/1998 |
| SU | 1614816 | 12/1990 |
| SU | 1644984 | 4/1991 |
| SU | 1644984 A1 * | 4/1991 |
| SU | 1720666 | 3/1992 |

* cited by examiner

*Primary Examiner* — Glenn Richman
(74) *Attorney, Agent, or Firm* — Aleksandr Smushkovich

(57) ABSTRACT

A device for varying a load applied to a vertical axis comprises a basic burden capable of vertical movement, a hinge with a horizontal axis, a lever having an end coupled to the hinge and capable of rotating around the horizontal axis, and a revolving means (a roller or pinion) for revolving about an axis mounted on the basic burden and extending essentially parallel to the horizontal axis, wherein the lever freely leans against the revolving means. In embodiments, the device may preferably comprise a supplemental burden secured in the region of the other end of lever. The lever may consist of two parallel rods fixedly attached to each other and pivotable around a common axis, or the rods can be independent, pivotable around the corresponding axis. The device provides convenient changing the load in the positive and negative phases of movement. It's usable in fitness, or for other purposes.

4 Claims, 3 Drawing Sheets

DEVICE FOR CHANGING LOAD AT ANY PHASE OF MOVEMENT

CROSS-REFERENCE TO RELATED APPLICATIONS

This application is a U.S. national stage application of a PCT application PCT/RU2008/000746 filed on 28 Nov. 2008, published as WO2009/082266, whose disclosure is incorporated herein in its entirety by reference, which PCT application claims priority of a Russian Federation application RU2007147696 filed on 20 Dec. 2007.

FIELD OF THE INVENTION

The invention concerns mainly the area of manufacturing of sports training apparatus, but also can be used in other areas of mechanical engineering, when it is necessary to smoothly increase or decrease the axial load applied to an axis.

BACKGROUND OF THE INVENTION

In trainings of sportsmen, mainly in bodybuilding and power-lifting, there is often a requirement of smooth increase in loading either in a positive, or in a negative movement phases.

Adaptations for an increase of the load in the negative phase are unknown. For getting this effect in trainings, a sportsman usually uses the help of a partner putting additional pressure upon a basic burden.

For increasing the load in the positive phase one usually uses metal chains secured on the basic burden. Thusly, the weight of the chains creates an additional burden thereby increasing the load for muscles of the sportsman. In the process of lowering the basic burden, the chain's links lay down on the floor, and the weight of additional burden decreases. In the process of lifting the basic burden, the chain links get off the floor, increasing the weight of additional burden.

The above described method has the following shortcoming: for athletes of different levels of preparation, it is necessary to use chains of different weights. It demands the presence of a considerable quantity of chains, creates difficulties in their storage and moving in an exercise room.

BRIEF SUMMARY OF THE INVENTION

The inventive device is herein proposed for changing a load in various phases of movement. In preferred embodiments, the device comprises a basic burden capable of vertical movement; a hinge with a horizontal axis; a lever having an end coupled to the hinge and capable of rotating around the horizontal axis; and a revolving means (a roller or a pinion) for revolving about an axis fixedly mounted on the basic burden and extending essentially parallel to the horizontal axis, wherein the lever freely leans against the revolving means. In embodiments, the device may preferably comprise a supplemental burden secured in the region of the other end of lever. The lever may consist of two parallel rods fixedly attached to each other and pivotable around a common horizontal axis, or the rods can be independent and each pivotable around its own horizontal axis. The device provides convenient varying the load in the positive and negative phases of movement. It's usable in fitness, or in other areas, where it is necessary to smoothly vary the load.

DETAIL DESCRIPTION OF PREFERRED EMBODIMENT OF THE INVENTION

While the invention may be susceptible to embodiment in different forms, there are described in detail herein below, specific embodiments of the present invention, with the understanding that the present disclosure is to be considered an exemplification of the principles of the invention, and is not intended to limit the invention to that as illustrated and described herein.

Figure 1:
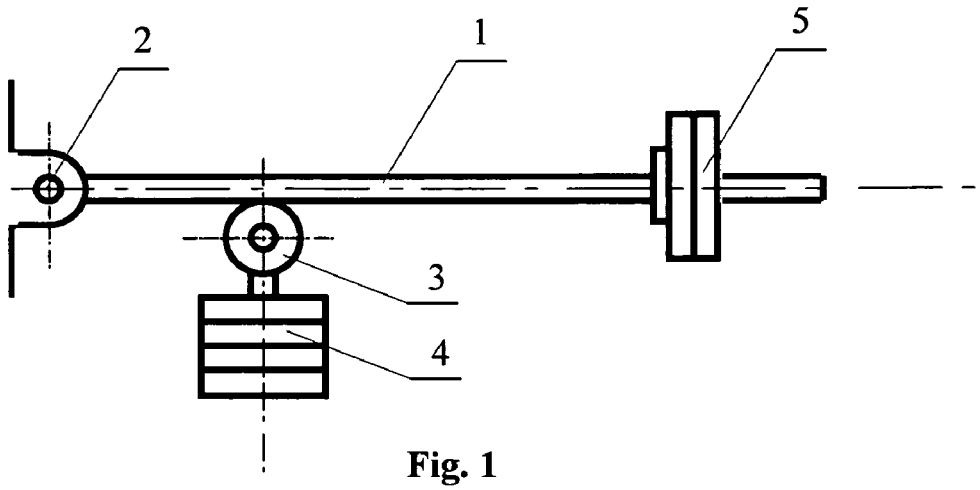
FIG. 1 is a schematic view of the proposed device, having a lever, which lever is positioned horizontally, according to an embodiment of the present invention.

A preferred embodiment of the inventive device is illustrated on FIG. 1 and comprises a lever 1, having a first end fixed on a hinge with a horizontal axis of rotation 2; the lever 1 freely leans against a roller (or a pinion) 3, capable of revolving about an axis of rotation parallel to the axis 2. The axis of rotation of the roller (pinion) 3 is fixedly mounted on a basic burden 4 that can move only vertically.

Figure 2:
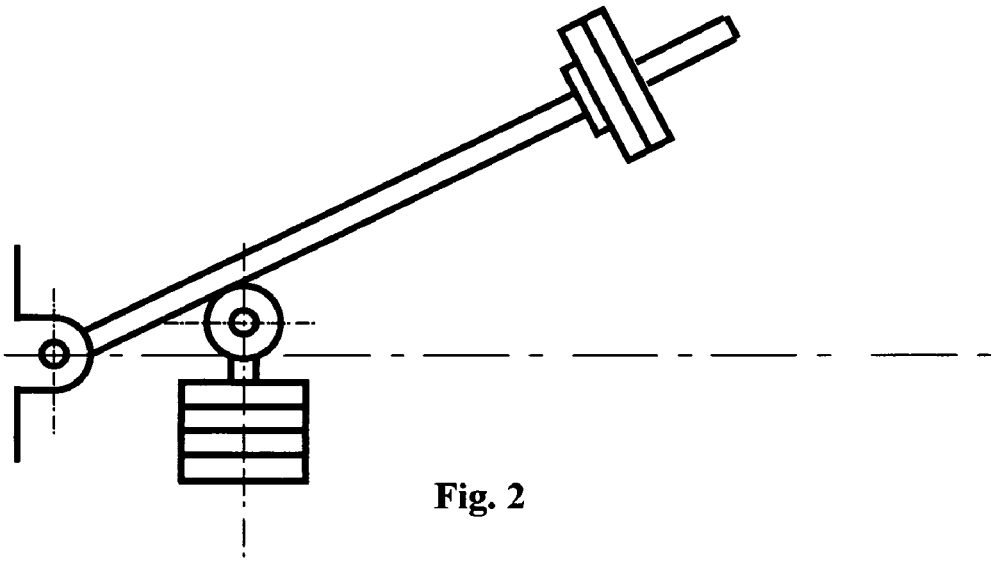
FIG. 2 is a schematic view of the proposed device, wherein its lever is positioned at a positive angle in relation to the horizon, according to the embodiment of the present invention shown in FIG. 1.
Figure 3:
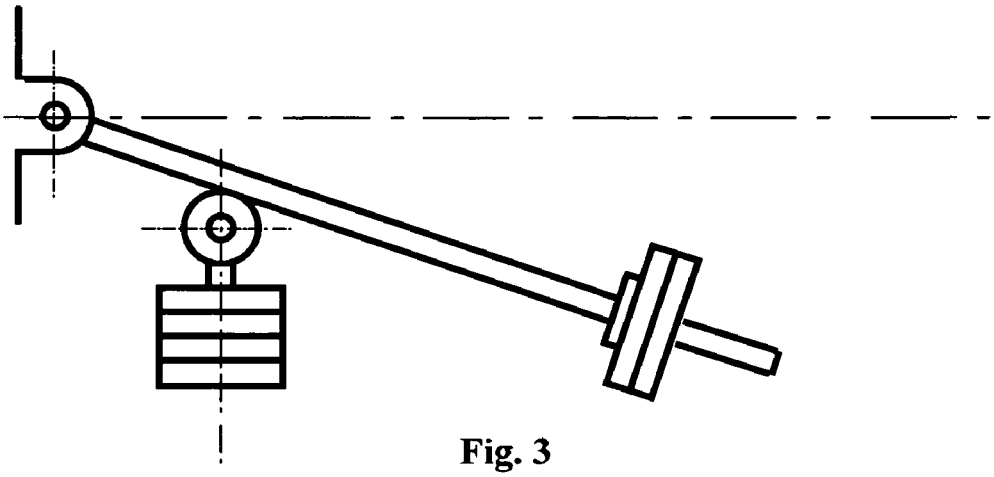
FIG. 3 is a schematic view of the proposed device, wherein its lever is positioned at a negative angle in relation to the horizon, according to the embodiment of the present invention shown in FIG. 1.
Figure 4:
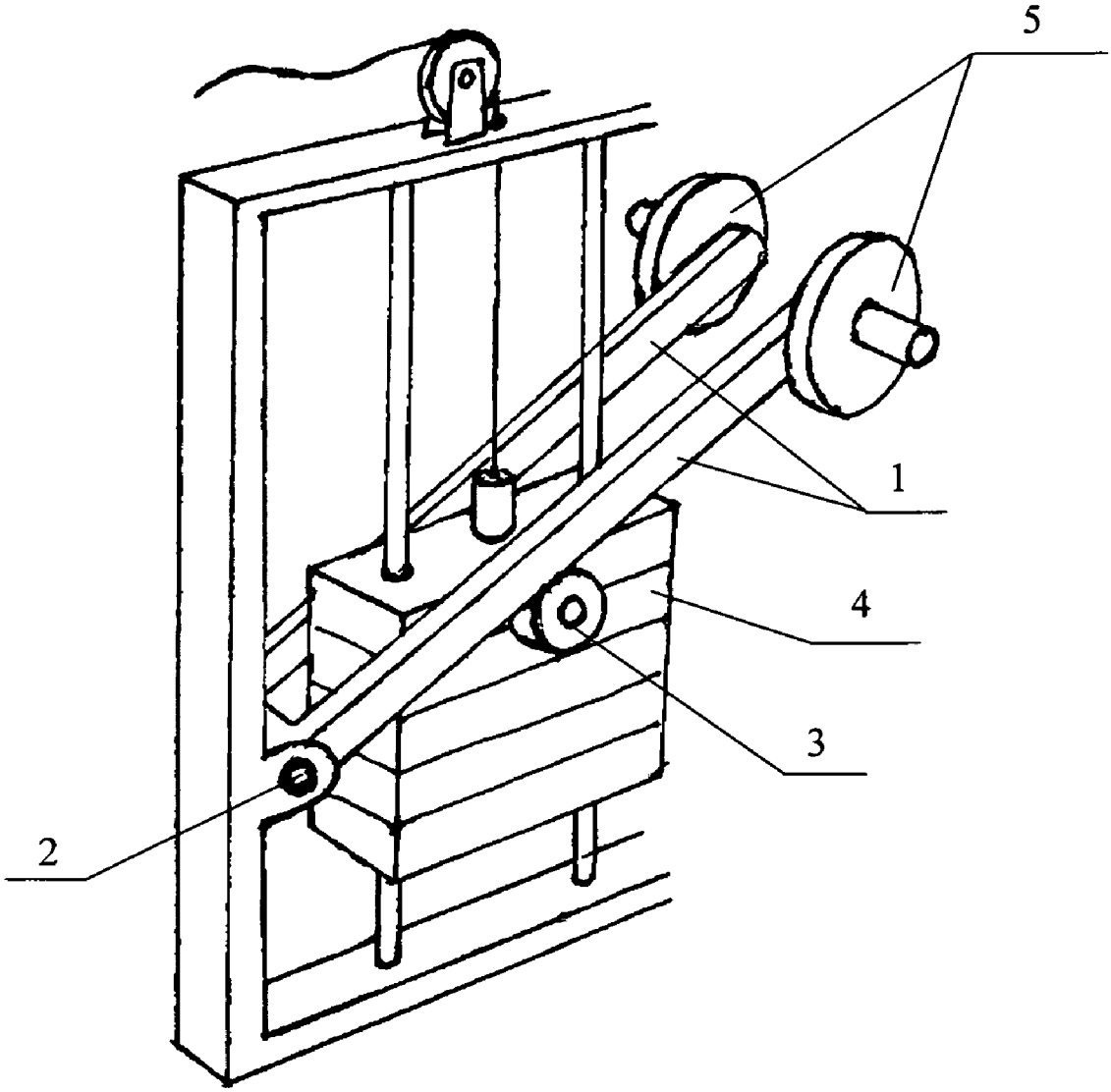
FIG. 4 is a perspective view of the proposed device, wherein its lever is composed of two essentially parallel rods fixedly mounted to each other and pivotable around a common axis, according to an embodiment of the present invention.
Figure 5:
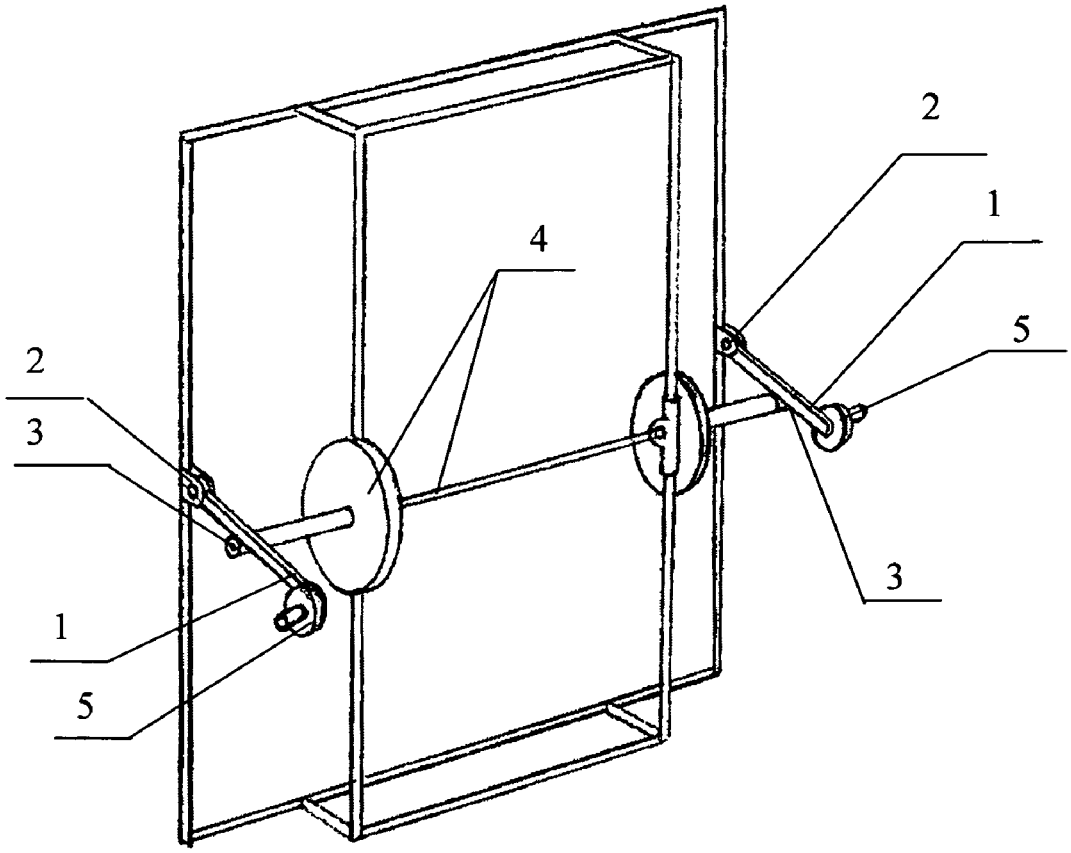
FIG. 5 is a perspective view of the proposed device, wherein its lever is composed of two essentially parallel rods each pivotable around its own axis, according to another embodiment of the present invention.

Due to gravitation, the lever 1 acts upon the roller (pinion) 4 with a variable force depending on the shoulder determined by an angle of leaning against the roller (pinion) as illustrated on FIGS. 2 and 3, which variable force is subsequently applied to the basic burden 4 and changes the load for the sportsman. A supplemental burden 5 (FIGS. 1-5) is preferably secured on the lever 1, preferably in the region of the second end of the lever. In alternative embodiments, the weight of the lever 1 might be sufficient to create a necessary additional load without the use of a supplemental burden.

In a position, depicted on FIG. 1, where the lever 1 is located horizontally, and its weight renders the maximum pressure on the axis of roller (pinion) 3, since the shoulder of acting force is maximal. This position is characterized by the maximal load.

The movement of the basic burden 4 above the horizontal position of the lever 1 (the movement is depicted on FIG. 2), in a positive phase (wherein the athlete lifts the burden 4), the load smoothly decreases due to a reduction of the shoulder, and, in a negative phase (wherein the athlete lowers the burden 4), the load smoothly increases due to an expansion of the shoulder.

The movement of the basic burden 4 below the horizontal position of the lever 1 (the movement is depicted on FIG. 3), the load smoothly increases in the positive phase, and smoothly decreases in the negative phase.

It is possible to change a degree of increase or decrease in the loading in both phases of movement by varying the weight of the supplemental burden 5.

For providing symmetry of the load, it is preferable to use the lever 1 consisting of two essentially parallel rods fixedly attached to each other (as shown on FIG. 4) and attached to two hinges pivotable around a common axis 2 formed by joining the two axes 2 of each hinge.

Alternatively, the lever 1 may consist of two essentially parallel independent rods (as shown on FIG. 5) attached to two hinges, wherein each rod is pivotable around one corresponding independent axis 2.

The invention claimed is:

1. A device for changing a load in various phases of movement comprising:

a basic burden capable of substantially vertical movement;

at least one hinge with a horizontal axis substantially disposed in a horizontal level;

a lever having a first end coupled to said at least one hinge and capable of rotating around said horizontal axis, and a second end capable of positioning above the horizontal level; and at least one revolving means for revolving about an axle fixedly mounted on said basic burden and extending essentially parallel to said horizontal axis;

wherein said lever freely leans against said at least one revolving means, and wherein said lever is positioned along the horizontal level while providing a maximum load;

said lever is positioned at a positive angle to the horizontal level, while providing an increase of the load up to the maximal load during a positive phase of movement, and providing a decrease of the load from the maximal load during a negative phase of movement; and said lever is positioned at a negative angle to the horizontal level, while providing a decrease of the load from the maximal load during a positive phase of movement, and providing an increase of the load up to the maximal load during a negative phase of movement.

2. The device according to claim 1, wherein said lever having a second end; and said device further comprising a supplemental burden secured in the region of said second end.

3. The device according to claim 1, wherein said device comprises two hinges each having a substantially horizontal axis while the horizontal axes substantially coincide and form a common axis, and said lever consists of two essentially parallel rods fixedly attached to each other and capable of rotating about said common axis.

4. The device according to claim 1, wherein said device comprises two independent hinges with substantially horizontal axes, and said lever consists of two independent essentially parallel rods each capable of rotating about the corresponding substantially horizontal axis.

* * * * *